United States Patent [19]

Ohlgren

[11] Patent Number: 4,550,807

[45] Date of Patent: Nov. 5, 1985

[54] BUILDING CONSTRUCTION LIFT APPARATUS

[76] Inventor: Eilef J. Ohlgren, Rte. 2, Box 23, Clear Lake, Minn. 55319

[21] Appl. No.: 520,419

[22] Filed: Aug. 4, 1983

[51] Int. Cl.[4] ..... B66B 9/20

[52] U.S. Cl. ..... 187/10; 182/141

[58] Field of Search ..... 187/10, 9 R, 12, 11, 187/6, 2; 182/141, 63, 103, 102, 101; 414/595, 592

[56] References Cited

U.S. PATENT DOCUMENTS

| | | | |
|---|---|---|---|
| 764,187 | 7/1904 | Gilmore et al. | 187/6 |
| 1,312,089 | 8/1919 | Anderson | 187/10 |
| 2,122,908 | 4/1937 | Collins | 187/6 |
| 2,836,308 | 5/1958 | Lamb | 187/6 |
| 3,592,294 | 7/1971 | Allen | 182/103 |
| 3,666,046 | 5/1972 | Meinecke, Jr. | 182/145 |
| 3,891,062 | 6/1975 | Geneste | 187/10 |
| 3,896,904 | 7/1975 | Walker | 187/9 R |
| 4,183,423 | 1/1980 | Lewis | 187/10 |
| 4,184,570 | 1/1980 | Edwards | 187/6 |
| 4,262,773 | 4/1981 | Basham | 182/132 |

*Primary Examiner*—Joseph J. Rolla
*Assistant Examiner*—Kenneth Noland
*Attorney, Agent, or Firm*—Merchant, Gould, Smith, Edell, Welter & Schmidt

[57] ABSTRACT

A portable lift apparatus for use in building construction. Two vertical members with attached endless chains or cables move lift members to the top of a building. The lift members pivot to lay their load flat at the top of the building. The vertical members are detachably connected together by a dual universal joint mechanism. When this connection is detached, the device is as portable as a ladder.

4 Claims, 8 Drawing Figures

Fig. 1
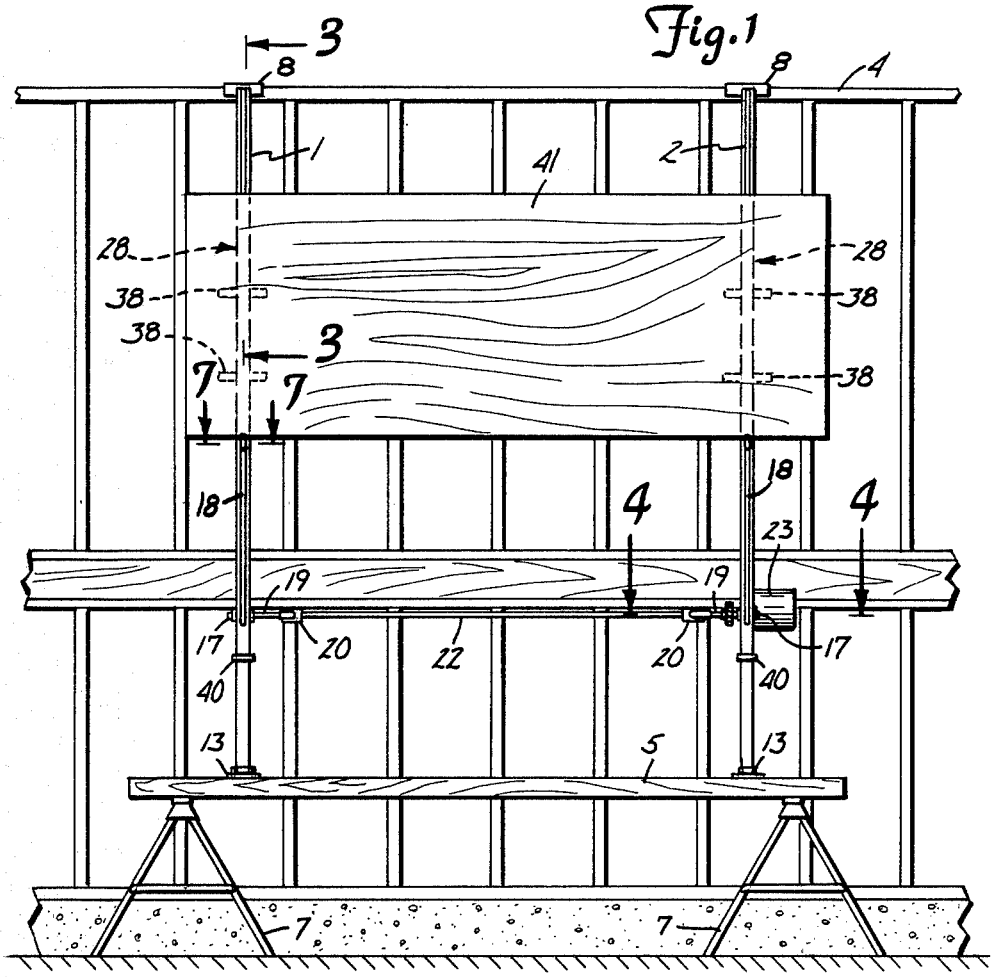
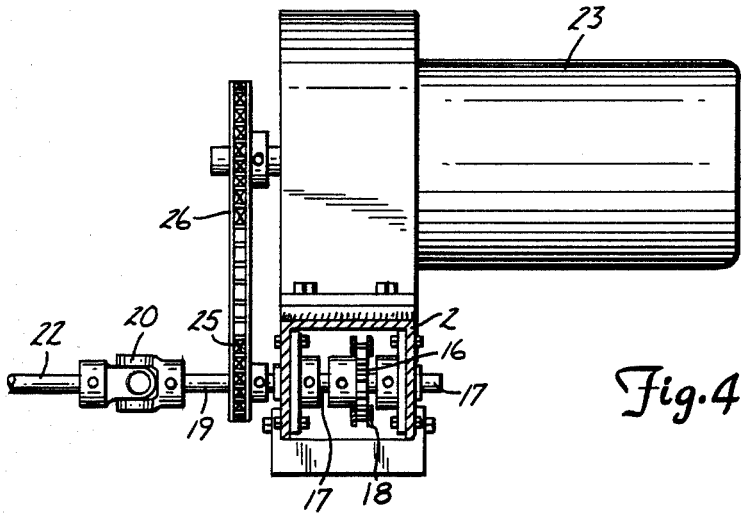
Fig. 4

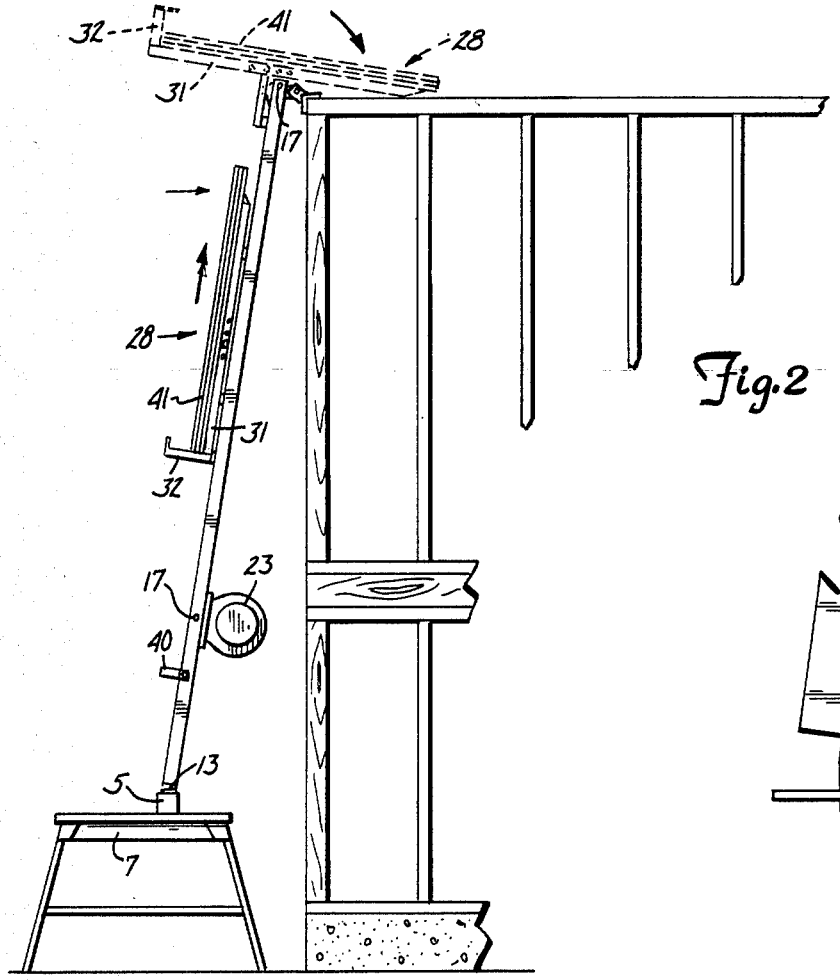
Fig.2
Fig.5
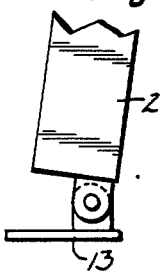
Fig.6
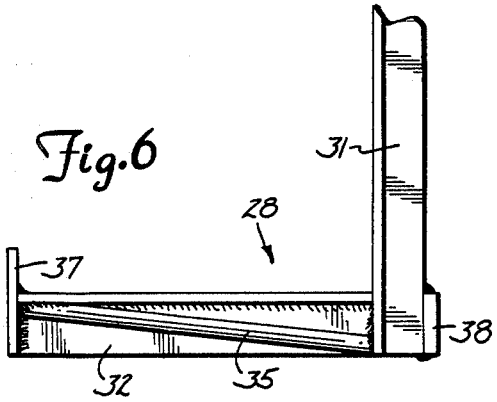
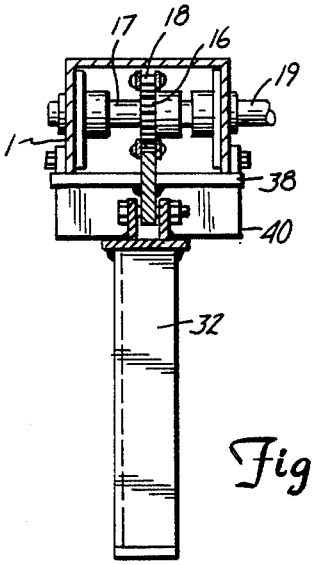
Fig.7

BUILDING CONSTRUCTION LIFT APPARATUS

BACKGROUND OF THE INVENTION

The present invention relates to devices for lifting materials, particularly those used in the building construction trade.

In constructing a house or other building it is necessary to lift many items to or near the top of the building. A prime example is the trusses used to support the roof in a normal individual home. These trusses are generally pre-assembled on the ground or in a factory, raised by one means or another to the top of the house frame and then attached in the appropriate locations. Additional examples are the sheets of plywood often placed on the tops of these trusses to form the basis for the roof and the singles in turn placed on top of the plywood.

In the past, these items have generally been lifted to the housetop by one of three techniques: first, the materials may be lifted by a crane. While a crane can lift the materials farther than any of the other techniques, it has the distinct disadvantage of being very expensive. Second, the materials may be lifted by a forklift. While this technique is much less expensive than using a crane, it still requires the use of a fairly expensive piece of equipment which is designed primarily for moving materials, not lifting them to the tops of buildings. Third, one or more ladders may be placed against the side of the house and the materials manually carried up them. This is unquestionably the least expensive technique, but it also poses the greatest risk of injury to the persons employing it.

It is the purpose of the present invention to provide a device for raising materials to the top of a building which is considerably less expensive than a forklift, while being simultaneously as portable as a ladder and significantly safer.

SUMMARY OF THE INVENTION

According to the present invention a comparatively lightweight lift apparatus is provided which is easily disassembled and reassembled for portability. The main support structure of the apparatus is provided by two support members, preferably beams with a U-shaped cross section. In operation, these beams are held in position by three devices: first, a plate is provided at the top of each beam which may be nailed or otherwise attached to the top beam of the house involved. Second, a support plate is pivotably mounted at the bottom of each beam so that the plate may rest flat on the ground or other support for the apparatus while allowing the support members to rotate through a broad range of angles. By this mechanism, the apparatus may rest on uneven terrain. Third, the support members are detachably connected by a rod and universal joint mechanism discussed further below in connection with the operation of the apparatus.

In the preferred embodiment, each support member has two sprocketed pulleys mounted on it, one at the top and one near the bottom. An endless chain passes around these pulleys and interacts with the sprockets such that when the pulleys are turned the chain moves. An L-shaped bracket, or lift member, is attached to a portion of the endless chain such that the lift member will move with the endless chain.

The lift member is designed to support the materials being raised and to pivot when it reaches the top end of the support member. Several pivot points are provided so that the pivot point may always be kept below the center of gravity of the lift member and materials being lifted. Gravity will then cause the lift member to pivot automatically when it reaches the top end of the support member. Due to this pivoting the materials being carried will be laid flat at the top of the house.

It will be readily apparent that while use of an endless chain in the fashion described is the preferred embodiment, many alternative embodiments would accomplish the same result, for example, the use of a cable being wound upon a spool with the lift member attached at the end of the cable.

Returning to the preferred embodiment, the bottom pulleys on each support member are detachably connected by the rod and universal joint mechanism mentioned above. More specifically, the center axis of each pulley is attached to a rod such that when the rod rotates the pulley will rotate. Each rod is in turn connected to a universal joint. The two universal joints are then connected by a connecting member. The entire mechanism interacts so that when any one member of it is rotating, all of the members are rotating, and at the same rates. A motor is mounted on one of the support members and connected to the rod mounted on the pulley on that support member to provide power to rotate the rod and universal joint mechanism. The result of this is that when the motor rotates one of the pulleys, the other pulley is rotated at the same rate and the two lift members are moved up or down the support members at identical rates for identical distances.

There are several benefits to using this dual univeral joint mechanism. The mechanism will operate even when the two support members are not in perfect alignment with each other. The spacing between the two support members may be changed simply by substituting a connecting member of a different length. In this fashion the same apparatus may be easily used for lifting thirty-foot-long trusses and eight-foot-wide sheets of plywood. Finally, once the connecting mechanism is removed, the two support members are no bulkier than an ordinary ladder. Since connection and disconnection of the connecting member is easily accomplished, this makes the entire apparatus highly portable.

When U-shaped support members are used, the pulleys and endless chain are most readily mounted on the inside of the U. If this is done it is advisable to add cross bars to the lift member when extend past the edges of the U. The cross bars serve to stabilize the lift member by allowing it to rest against the support member. The cross bars also prevent the lift member from being pulled into the U and jamming the mechanism.

While Applicant believes that the patentability of the present invention is readily apparent, further support for this position was obtained at the Twenty-Sixth Annual Minnesota Inventor's Congress, held June 10–12, 1983. The Congress awarded Applicant's invention the Third Place prize in its Industrial Section.

These and various other advantages and features of novelty which characterize the invention are pointed out with particularity in the claims annexed hereto and forming a part hereof. However, for a better understanding of the invention, its advantages, and objects attained by its use, reference should be had to the drawings which form a further part hereof, and to the accompanying descriptive matter, in which there is illustrated and described a preferred embodiment of the invention.

BRIEF DESCRIPTION OF THE DRAWINGS

FIG. 1 is a front elevational view of a preferred embodiment of the invention.

FIG. 2 is a side elevational view of the embodiment shown in FIG. 1.

FIG. 4 is a fragmentary cutaway generally along the line 4—4 in FIG. 1.

FIG. 5 is a fragmentary detail of a portion of FIG. 2.

FIG. 6 is a fragmentary detail of another portion of FIG. 2.

FIG. 7 is a cutaway generally along line 7—7 in FIG. 1.

DETAILED DESCRIPTION OF THE PREFERRED EMBODIMENT

Figures 3, 8:
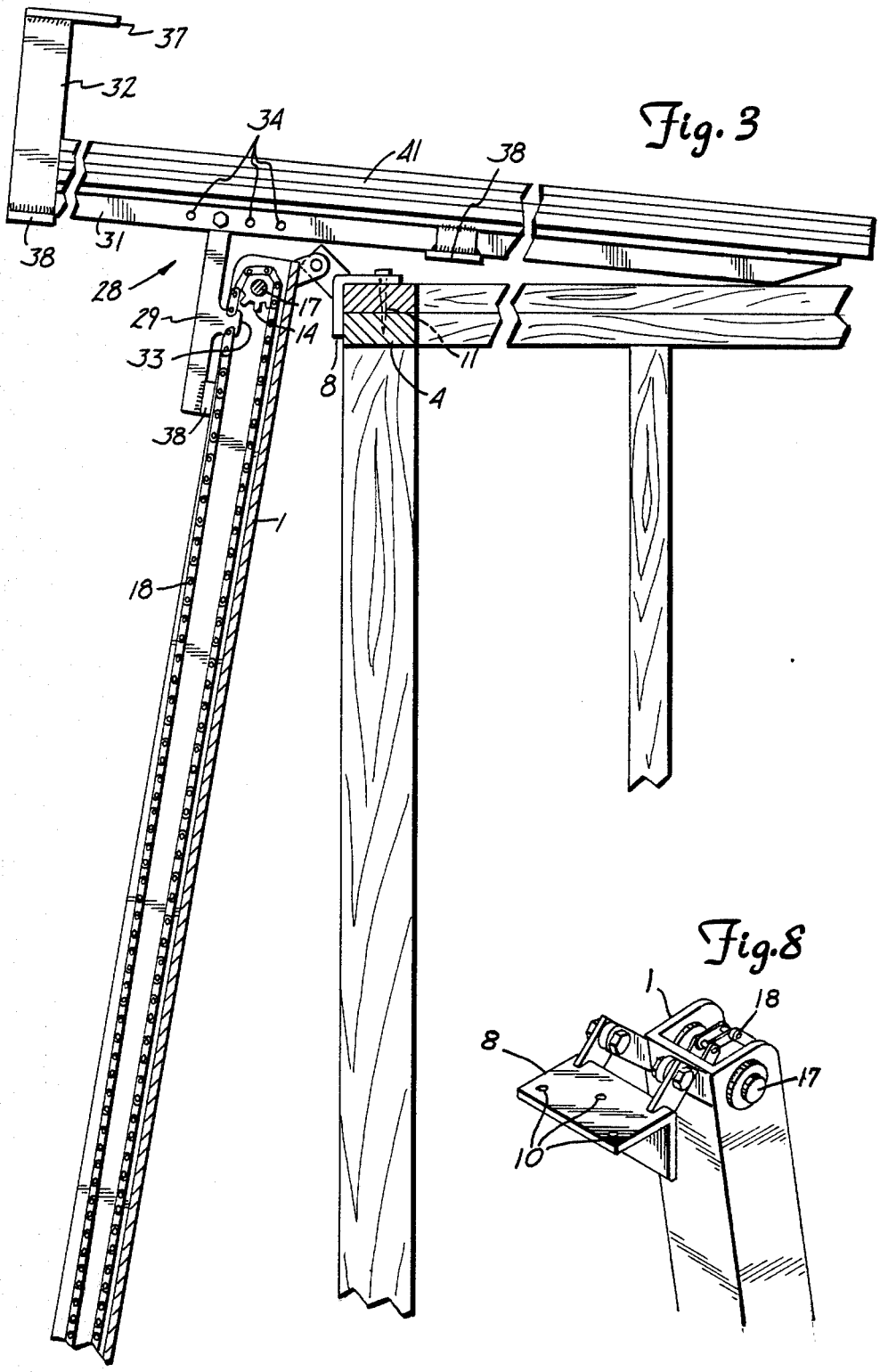
FIG. 3 is a fragmentary cutaway generally along the line 3—3 in FIG. 1.
FIG. 8 is a fragmentary perspective detail of the support bracket at the top end of one of the vertical members of the embodiment of the invention shown in FIG. 1.

The preferred embodiment of the present invention will be explained with reference to FIGS. 1 through 8, in which like elements are designated with like reference numbers.

With reference to FIG. 1, the apparatus has two main substantially vertical components, a left support member 1 and a right support member 2. These support members 1 and 2 extend from the top rail 4 of the building under construction to a bottom support, here shown as a plank 5 resting on two sawhorses 7. As best shown in FIGS. 3 and 8, a corner bracket, or angle iron, 8 is pivotally connected to the top end of each of said support members 1 and 2. Holes 10 are formed in each of said brackets 8 such that a nail 11 may be driven through them to secure the bracket 8 to the top rail 4. As best seen in FIGS. 2 and 5, each of said support members 1 and 2 also has a flat foot plate 13 pivotally mounted at its bottom end for supporting the apparatus.

The support members 1 and 2 are substantially U-shaped, as best seen in FIG. 8. Each support member 1 and 2 has two sprocketed pulleys, a top pulley 14 and a bottom pulley 16, mounted on the inside of the U of the support member 1 or 2 by means of axles 17 for rotation about the center axis of each respective pulley. Two endless chains 18, one for each support member 1 and 2, pass around the top pulley 14 and bottom pulley 16 of each support member. Each endless chain 18 interacts with the sprockets on the pulleys 14 and 16 such that the endless chain 18 moves when the pulleys 14 and 16 are rotated. Details of the pulleys 14 and 16 and of the endless chains 18 are best seen in FIGS. 3, 4 and 7. The locations of the pulleys 14 and 16 are best seen by noting the locations of the axles 17 in FIG. 2.

With reference to FIGS. 1 and 4, the center axle 17 of each bottom pulley 16 is fixedly attached to one end of rods 19 extending through one side of the support member 1 or 2 in which the pulley 16 is mounted. Alternatively, the rods 19 may be extensions of the axles 17. In either case, the ends of said rods 19 are attached to universal joints 20. A connecting member 22 detachably connects the ends of the universal joints 20 which are not connected to the rods 19. By these connections, the bottom pulleys 16, axle 17, rods 19, universal joints 20 and connecting member 22 interact such that when any one of them is rotated, all of them are rotated in the same degree.

With reference to FIGS. 1 and 4, a motor 23 is mounted on the right support member 2. The motor interacts with a sprocketed pulley 25 mounted on one of the rods 19 by means of an endless chain 26 to turn the rod 19. Turning this rod 19 in turn causes the bottom pulleys 16 to rotate and the endless chains 18 to move, as described above.

As best seen in FIG. 3, a lift member 28 is attached to each endless chain 18. Each lift member 28 has three main parts: a pivot bar 29, a long side bar 31 and a support bar 32. The pivot bar 29 is a relatively short bar attached directly to the endless chain 18. While FIG. 3 shows a portion 33 of the pivot bar 29 acting as a link in the endless chain 18, other means of attachment, such as welding the pivot bar 29 to a link in the endless chain 18, are quite adequate. The top end of the pivot bar 29 is pivotally connected to the long side bar 31. The support bar 32 is orthogonally attached to that end of the long side bar 31 which is at the bottom when the long side bar 31 is in a substantially vertical position, as shown in FIG. 2.

The connection between the pivot bar 29 and the long side bar 31 may be made at any one of several pivot points 34 on the long side bar 31 so that the pivot point 34 may be shifted with respect to the center of gravity of the lift member when necessary to properly balance the load 41 being carried. Preferably, the center of gravity is kept above the pivot point 34 to that gravity will cause the lift member 28 to pivot when it reaches the top end of the support member 1 or 2.

As best seen in FIG. 6, the support bar 32 is braced by a diagonal cross brace 35 and has a lip 37 at its end opposite from the long side bar 31. Strength is provided by the cross brace 35 and materials are prevented from sliding off of the support bar 32 by the lip 37.

Referring to FIGS. 1 and 3, cross bars 38 are attached at various points along the three parts of the lift member 28. These cross bars 38 extend transversely of the lift member parts beyond the edges of the support members 1 and 2. This holds the lift member 28 in a more stable position when it is parallel to the support members 1 and 2, and prevents the lift member 28 from being drawn into the U of the support members 1 and 2 and jamming the apparatus.

FIG. 2 shows the lift member 28 in both the substantially vertical position and, in dashed lines, after it has pivoted. In use, the lift members 28 are lowered until they rest on stops 40 which are attached to the support members 1 and 2. Materials 41 to be lifted are then rested on the support bar 32 and against the long side bar 31. The motor 23 is then activated, causing the endless chains 18 to move. This in turn lifts the lift member 28 to the top of the apparatus. When the lift members 28 reach the top of the apparatus, the lift members 28 will pivot around a pivot point 34 so that the load 41 being carried is laid flat at the top of the building.

To move the apparatus from one building to another, the connecting member 22 is detached from at least one of the universal joints 20 and the nails 11 are removed. The entire assembly may then be collapsed into no more space than a normal ladder and moved in a fashion comparable to a ladder. When the apparatus is reassembled, the two universal joints 20 will allow the mechanism to function properly even if the support members 1 and 2 are not parallel or co-planar. The distance between the support members 1 and 2 may be varied simply by changing the length of the connecting member 22 used in the apparatus.

Thus, it will be seen that the present invention provides a readily transportable lift apparatus with a high degree of flexibility. Since no one must stay balanced on a ladder while lifting materials, the device is also significantly safer than a ladder.

It is to be understood that while numerous characteristics and advantages of the invention have been set forth in the foregoing description, together with details of the structure and function of the invention, the disclosure is illustrative only and changes may be made in detail, especially in matters of shape, size and arrangement of parts within the principle of the invention, to the full extent indicated by the broad general meaning of the terms in which the appended claims are expressed.

What is claimed is:

1. A portable lift apparatus for use in building construction comprising:

(a) two elongated spaced apart support members extending in a generally vertical direction, each including an upper end and a lower end;

(b) each of said elongated support members including separate means for independently stabilizing said elongated support members with respect to a building structure;

(c) conveyor means associated with each of said elongated support members for movement generally along the longitudinal extent of said elongated support members between said upper and lower ends;

(d) said conveyor means of each of said elongated support members being operatively interconnected to one another by universal joint means providing for cooperative conveying action by said conveyor means such that said conveyor means move at generally the same speeds and in generally the same direction, said universal joint means being readily detachable to enable said conveyor means to be readily interconnected for operation and disconnected for transport; and (e) said conveyor means each including a lift bracket means for cooperatively supporting an article conveyed by said conveyor means, said lift bracket means being configured to pivot said article toward the building structure about a generally horizontal axis proximate the upper ends of said elongated support members, said lift bracket means including a generally L-shaped bracket positioned on a side of said elongated support member facing away from the building structure, said L-shaped bracket including an upper and a lower end and including a first portion extending between said upper and lower ends substantially parallel to its associated elongated support member and a second portion proximate said lower end of said L-shaped bracket extending generally away from the building at roughly a right angle from said first portion, said L-shaped bracket being pivotally interconnected to said conveyor means at a point along said first portion, said L-shaped brackets and their associated article having a center of gravity above that of the pivot point, biasing the upper end of said L-shaped brackets toward the elongated support members, said pivot points extending beyond the upper ends of said elongated support members when said L-shaped brackets are conveyed to a position proximate the upper ends of said elongated support members whereby said L-shaped brackets and their associated article pivot toward the building.

2. A lift apparatus for use in building construction comprising:

(a) two elongated structural support members extending in a generally vertical direction and each having top and bottom ends;

(b) means for supporting said support members at the bottom ends thereof and means for stabilizing said support members at the top ends thereof;

(c) on each of said support members, (i) a first pulley disposed at each of said top ends and a second pulley disposed near each of said bottom ends;

(ii) an endless chain passing around and supported by said first and second pulleys and interacting with means on said second pulley such that when said second pulley is rotated said endless chain moves around said pulleys;

(d) means for causing said second pulleys to rotate in either direction;

(e) universal joint means for operatively interconnecting said second pulleys such that said second pulleys rotate at generally the same speeds and in generally the same direction, said universal joint means being readily detachable to enable said second pulleys to be interconnected for operation and disconnected for transport; and (f) a lift member pivotally mounted to each of said endless chains such that said lift members move with said chains along said support members and tilt when said lift members reach said top ends, each of said lift members further comprising:

(i) a first bar having two ends, said bar being fixedly attached to a link in said endless chain and extending in a direction substantially parallel to said endless chain;

(ii) an elongated second bar having two ends, said second bar being pivotally mounted near the end of said first bar closest to the top ends of said structural support members and extending in a direction substantially parallel to said first bar;

(iii) a third bar attached to said second bar and extending orthogonally to said second bar, said third bar interacting with said second bar so that any materials being lifted by the lift apparatus will be supported and steadied by said second bar and said third bar.

3. A lift apparatus according to claim 2 wherein said lift members interact with said endless chains and said first pulleys such that when said lift members reach said top ends of said structural support members said lift members pivot to lay flat any materials being lifted by the lift apparatus.

4. A portable lift apparatus for use in building construction comprising:

(a) two elongated spaced apart support members extending in a generally vertical direction, each including an upper end and a lower end;

(b) each of said elongated support members including separate means for independently stabilizing said elongated support members with respect to a building structure;

(c) conveyor means associated with each of said elongated support members for movement generally along the longitudinal extent of said elongated support members between said upper and lower ends;

(d) said conveyor means of each of said elongated support members being operatively interconnected to one another by universal joint means providing for cooperative conveying action by said conveyor means such that said conveyor means move at generally the same speeds and in generally the same direction, said universal joint means being readily detachable to enable said conveyor means to be readily interconnected for operation and disconnected for transport;

(e) said conveyor means each including a lift bracket means for cooperatively supporting an article conveyed by said conveyor means, said lift bracket means being configured to pivot said article toward the building structure about a generally horizontal axis proximate the upper ends of said elongated support members;

(f) on each of said elongated support members, a chain passing around a first and a second pulley, the first pulley being mounted at said upper end of said support member, the second pulley being mounted near the lower end of said support member and at least one of said pulleys being sprocketed to interact with said chain such that when said sprocketed pulley rotates said chain passes around said pulleys and moves said lift bracket means, said lift bracket means being pivotally mounted on said endless chain; and (g) on the first of said elongated support members, (i) a motor connected to the sprocketed pulley mounted on the same elongated support member for causing said sprocketed pulley to rotate;

(ii) two or more rods and one or more universal joints detachably connected to each other and interacting to connect said motor with the sprocketed pulley mounted on the second of said support members to allow said motor to rotate said sprocketed pulley on said second support member and for adjusting the relative rotation rates of the sprocketed pulley mounted on the first said support member and the sprocketed pulley on the second said support member such that said lift members mounted on each of said chains will each move at substantially the same speeds and for substantially the same distance when said sprocketed pulleys are rotated by said motor.

* * * * *

UNITED STATES PATENT AND TRADEMARK OFFICE

CERTIFICATE OF CORRECTION

PATENT NO. : 4,550,807

DATED : November 5, 1985

INVENTOR(S) : Eilif J. Ohlgren

It is certified that error appears in the above-identified patent and that said Letters Patent is hereby corrected as shown below:

Col. 1, line 17, delete "singles" and insert --shingles--.

Col. 3, line 32, delete "shown" and insert --seen--.

Signed and Sealed this

Seventh Day of October, 1986

[SEAL]

*Attest:*

DONALD J. QUIGG

*Attesting Officer*

*Commissioner of Patents and Trademarks*